US009091504B2

(12) United States Patent
McDonald

(10) Patent No.: US 9,091,504 B2
(45) Date of Patent: Jul. 28, 2015

(54) OFFENSIVE AND DEFENSIVE PROTECTION DEVICE

(76) Inventor: Kenny McDonald, Sussex, NJ (US)

( * ) Notice: Subject to any disclaimer, the term of this patent is extended or adjusted under 35 U.S.C. 154(b) by 543 days.

(21) Appl. No.: 13/385,563

(22) Filed: Feb. 27, 2012

(65) Prior Publication Data

US 2013/0219583 A1 Aug. 29, 2013

(51) Int. Cl.
*A41D 19/00* (2006.01)
*F41B 15/00* (2006.01)
*F41B 15/06* (2006.01)

(52) U.S. Cl.
CPC ..... *F41B 15/00* (2013.01); *F41B 15/06* (2013.01)

(58) Field of Classification Search
CPC ..... A63B 71/14; A41D 19/015; A41D 13/08; A41D 19/01588; A41D 19/01594; F41B 15/00; F41B 15/06
USPC ..... 2/455, 18, 16, 20, 160, 161.1, 161.5, 2/158; 446/26, 144, 145, 147; 30/298, 30/159, 152, 291, 232, 295; D22/117, D22/118; 36/65, 66, 67 A, 67 B
See application file for complete search history.

(56) References Cited

U.S. PATENT DOCUMENTS 183,375 A * 10/1876 Cufliff ..... 2/161.8
325,194 A * 8/1885 Buck ..... 36/66
421,447 A * 2/1890 Stewart ..... 2/18
782,517 A * 2/1905 Niebuhr ..... 2/158
961,149 A * 6/1910 Maynard ..... 2/18
1,031,426 A * 7/1912 Czel ..... 36/65
1,053,204 A * 2/1913 Morrison ..... 2/158
1,243,622 A * 10/1917 Nielsen ..... 43/25
1,497,035 A * 6/1924 Skoglund ..... 15/227
1,537,811 A * 5/1925 Epling ..... 128/879
1,573,779 A * 2/1926 Broman ..... 36/65
1,583,754 A * 5/1926 Rogers ..... 294/25
1,594,151 A * 7/1926 Chance ..... 2/16
1,788,858 A * 1/1931 Canuel ..... 294/25
2,034,050 A * 3/1936 Levy ..... 36/59 R
2,278,610 A * 4/1942 Brownson et al. ..... 294/25
2,895,139 A * 7/1959 Compton ..... 2/161.8
3,116,502 A * 1/1964 Gerber ..... 15/105
3,185,476 A * 5/1965 Fechner ..... 473/596
3,236,553 A * 2/1966 Shrier ..... 294/25
3,415,244 A * 12/1968 Block ..... 128/879
3,593,803 A * 7/1971 Ibach ..... 172/10
3,746,356 A * 7/1973 Shipstad ..... 280/821
3,872,514 A * 3/1975 Liebelt ..... 2/159
3,981,526 A * 9/1976 Lundqvist ..... 294/25
4,027,339 A * 6/1977 Brucker ..... 2/16
4,096,629 A * 6/1978 Levine ..... 30/152
4,107,840 A * 8/1978 Kupperman et al. ..... 30/172
4,137,572 A * 2/1979 Jansson et al. ..... 2/16
4,149,601 A * 4/1979 Taylor ..... 172/370
4,242,715 A * 12/1980 Laird ..... 361/232

(Continued)

*Primary Examiner* — Alissa L Hoey

(57) ABSTRACT

A defensive or offensive weapon in the form of a mitten. The mantle of the mitten is either rigid or somewhat pliant. The interior of the mitten has located therein a cross bar to be grasped by a user to maintain the mitten on the arm of a user. The outer surface of the glove weapon has located thereon a plurality of outwardly directed spikes having pointed ends. The other end of the spikes has a screw threaded end which is screwed through the mantle of the mitten. The outer surface of the glove weapon has a plurality of dimples thereon, whereby each of the dimples has the screw end of the spike passing there through resulting in stabilizing each of the spikes in an outward direction.

3 Claims, 3 Drawing Sheets

(56) References Cited

U.S. PATENT DOCUMENTS

| | | | | | |
|---|---|---|---|---|---|
| 4,484,359 | A | * | 11/1984 | Tirinen | 2/20 |
| 4,538,320 | A | * | 9/1985 | Batt | 15/236.02 |
| 4,561,197 | A | * | 12/1985 | Misevich | 36/127 |
| 4,589,146 | A | * | 5/1986 | Taylor | 2/161.3 |
| 4,603,439 | A | * | 8/1986 | Golomb | 2/18 |
| 4,683,592 | A | * | 8/1987 | Strongwater | 2/17 |
| 4,765,628 | A | * | 8/1988 | Jensen | 473/589 |
| 4,766,914 | A | * | 8/1988 | Briggs | 132/212 |
| 4,870,712 | A | * | 10/1989 | Markus | 15/227 |
| 4,951,689 | A | * | 8/1990 | Jones | 2/161.1 |
| 5,058,278 | A | * | 10/1991 | Colvin | 30/298 |
| 5,095,547 | A | * | 3/1992 | Kerns | 2/160 |
| 5,325,596 | A | * | 7/1994 | Baker | 30/298 |
| 5,345,609 | A | * | 9/1994 | Fabry et al. | 2/20 |
| 5,379,179 | A | * | 1/1995 | Graves | 361/232 |
| 5,458,564 | A | * | 10/1995 | Franzen | 602/21 |
| 5,502,841 | A | * | 4/1996 | Stanford | 2/18 |
| 5,511,242 | A | * | 4/1996 | Bianchi | 2/16 |
| 5,644,796 | A | * | 7/1997 | Laughlin | 2/161.6 |
| 5,829,643 | A | * | 11/1998 | Isabella | 222/175 |
| 5,878,438 | A | * | 3/1999 | Ragsdale | 2/158 |
| 5,887,283 | A | * | 3/1999 | Mackay | 2/161.6 |
| 6,125,493 | A | * | 10/2000 | Daw | 15/111 |
| 6,182,379 | B1 | * | 2/2001 | Savage | 36/62 |
| 6,256,792 | B1 | * | 7/2001 | MacDonald | 2/161.1 |
| 6,298,489 | B1 | * | 10/2001 | Cox | 2/161.6 |
| 6,374,417 | B1 | * | 4/2002 | Stagnitta | 2/161.8 |
| 6,408,441 | B1 | * | 6/2002 | Smith et al. | 2/161.6 |
| 6,704,936 | B1 | * | 3/2004 | Carlin | 2/18 |
| 7,421,787 | B2 | * | 9/2008 | White et al. | 30/123 |
| 7,574,748 | B2 | * | 8/2009 | Fisher et al. | 2/16 |
| 7,743,690 | B2 | * | 6/2010 | White et al. | 83/13 |
| 7,757,303 | B2 | * | 7/2010 | Miller | 2/16 |
| 7,797,758 | B2 | * | 9/2010 | Keppler et al. | 2/21 |
| 2002/0013961 | A1 | * | 2/2002 | Kleinert | 2/16 |
| 2002/0148031 | A1 | * | 10/2002 | O'Dea et al. | 2/160 |
| 2005/0278828 | A1 | * | 12/2005 | Erickson | 2/161.5 |
| 2007/0266475 | A1 | * | 11/2007 | Frazier et al. | 2/161.1 |
| 2008/0209607 | A1 | * | 9/2008 | Kohler | 2/16 |
| 2009/0082179 | A1 | * | 3/2009 | Le | 482/88 |
| 2010/0236077 | A1 | * | 9/2010 | Shirey et al. | 30/152 |
| 2011/0252536 | A1 | * | 10/2011 | Hendon et al. | 2/160 |

* cited by examiner

OFFENSIVE AND DEFENSIVE PROTECTION DEVICE

BACKGROUND OF INVENTION

Gloves of various types have been utilized throughout the prior art to provide various exterior surfaces designed to be used in an offensive or defensive manner.

U.S. Pat. No. 4,096,629 discloses a multi-bladed weapon that may be likened in general appearance and function to retractable animal claws or talons. There is disclosed a hand held bar with protruding knives or claws. The knives extend through and between fingers and extend forwardly.

U.S. Pat. No. 4,242,715 teaches the use of a self-defense apparatus that includes a battery powered source of a high voltage arranged in an insulated housing and a finger attached probe.

U.S. Pat. No. 5,058,278 illustrates a self-defense weapon comprising a glove type mounting of three groups of projecting spikes for slashing and stabbing an opponent.

U.S. Pat. No. 5,095,547 discloses a glove including a plurality of flexible metal strips mounted in fixed communication to an exterior surface of every finger socket of a glove for use as a self-defense weapon.

U.S. Pat. No. 5,325,596 discloses a self-defense weapon in the form of a glove having retractable blades proximal the fingertips in which the retractable blades are activated by a trigger mechanism remote from the fingertips.

U.S. Pat. No. 5,829,643 teaches the use of a self-defense device for thwarting off a would-be attacker. The disclosed device includes a grasping member adapted for grasping by a user's hand including a plurality of spaced apart spikes.

BRIEF DESCRIPTION OF THE INVENTION

The inventive concept consists of a glove in the form of a mitten that has a plurality of outwardly directed spikes attached thereon that are distributed all over the mitten to thereby result in a plurality of spikes the points of which are directed in all different directions. There is a hand gripped bar on the inside of the glove that allows the user to securely grip the glove and be able to use it offensively and defensively. As a self defense weapon the user of the glove has the advantage that the glove and thereby the weapon cannot be grasped be an opponent because of the presence of the multiple spikes. The glove weapon may be used on an airplane to control unruly passengers. It can easily be stored in an appropriate bag in a strategic location and can easily be retrieved and quickly put on if the occasion arises. The glove weapon could also be stored in an automobile to deter would-be highjackers. It is readily apparent that the glove weapon can be stored and hidden anywhere where desired and where imminent danger may be present.

DETAILED DESCRIPTION OF THE INVENTION

Figure 1:
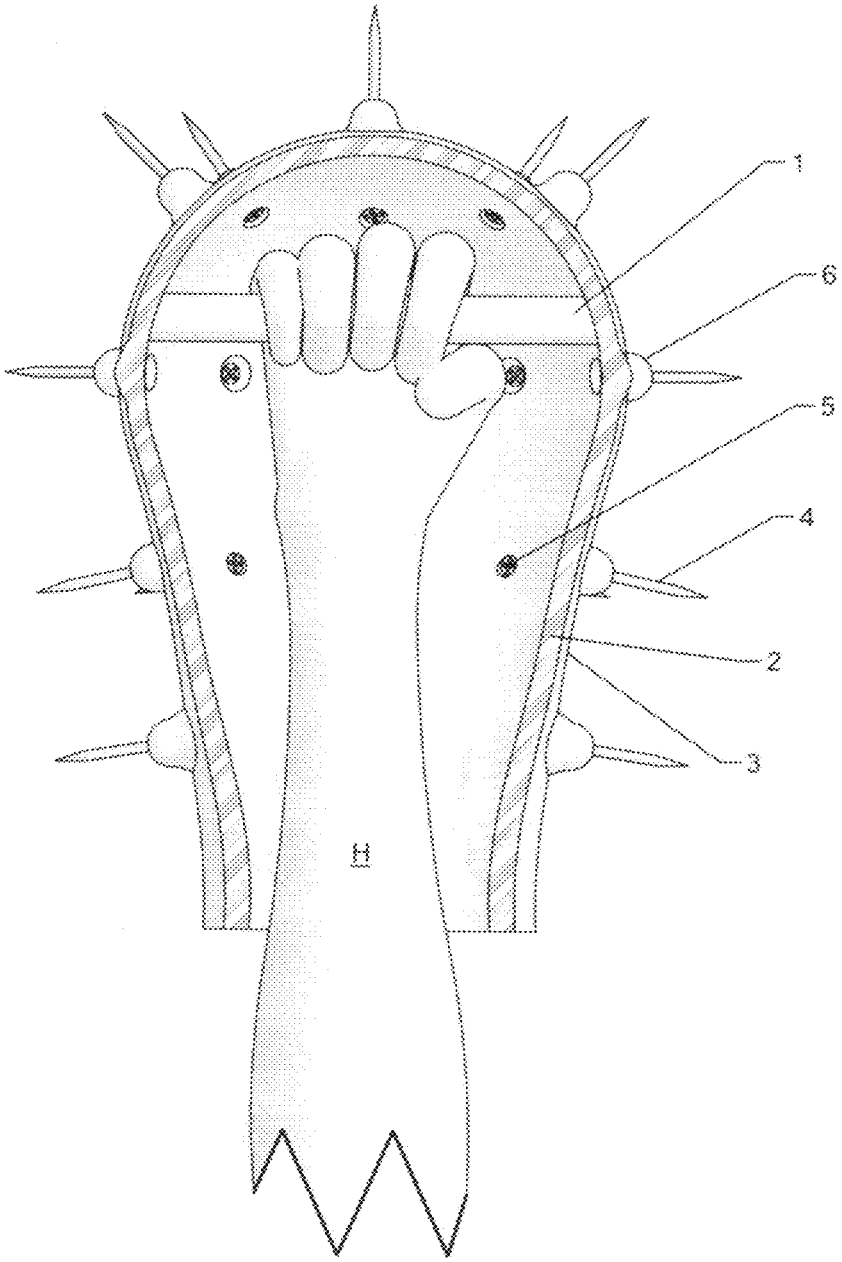
FIG. 1 is a cross section through the glove weapon.
Figure 2:
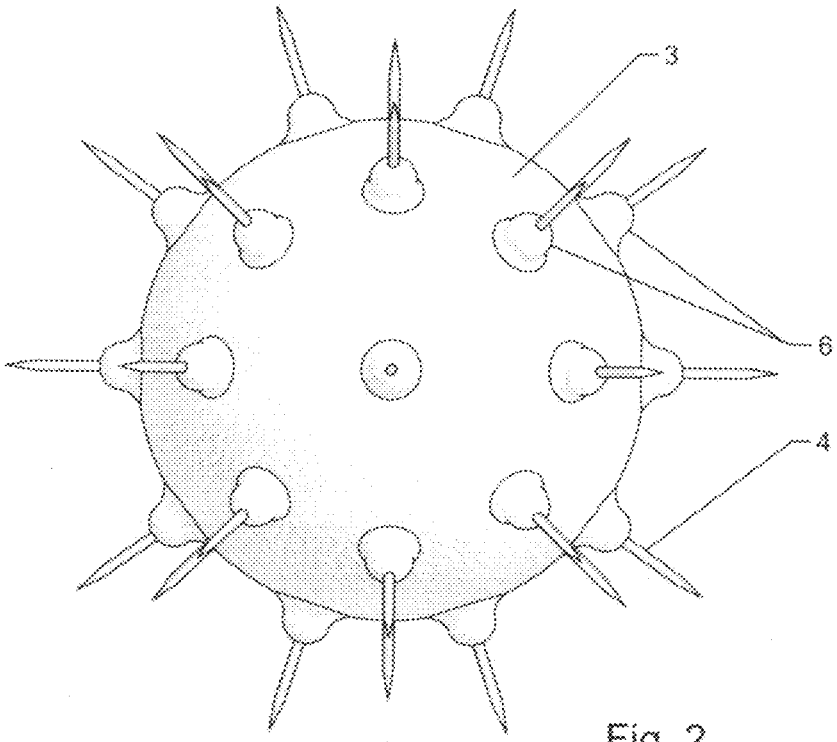
FIG. 2 is top view of the glove weapon.
Figure 3:
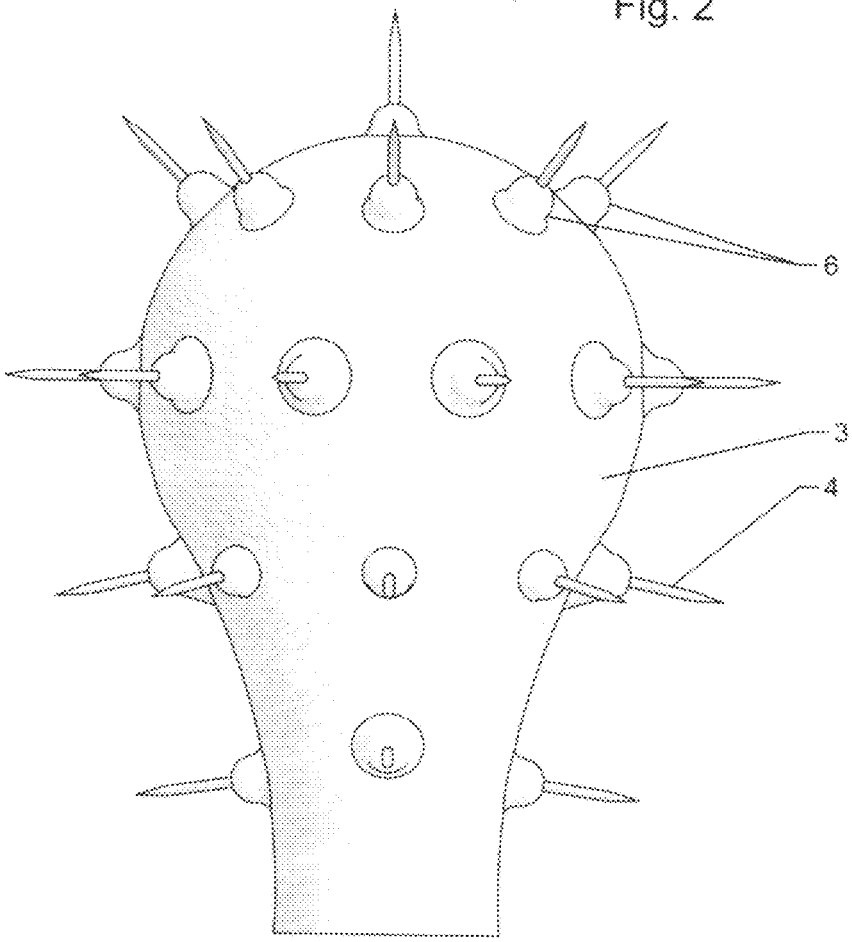
FIG. 3 is a side view of the glove weapon.
Figure 4:
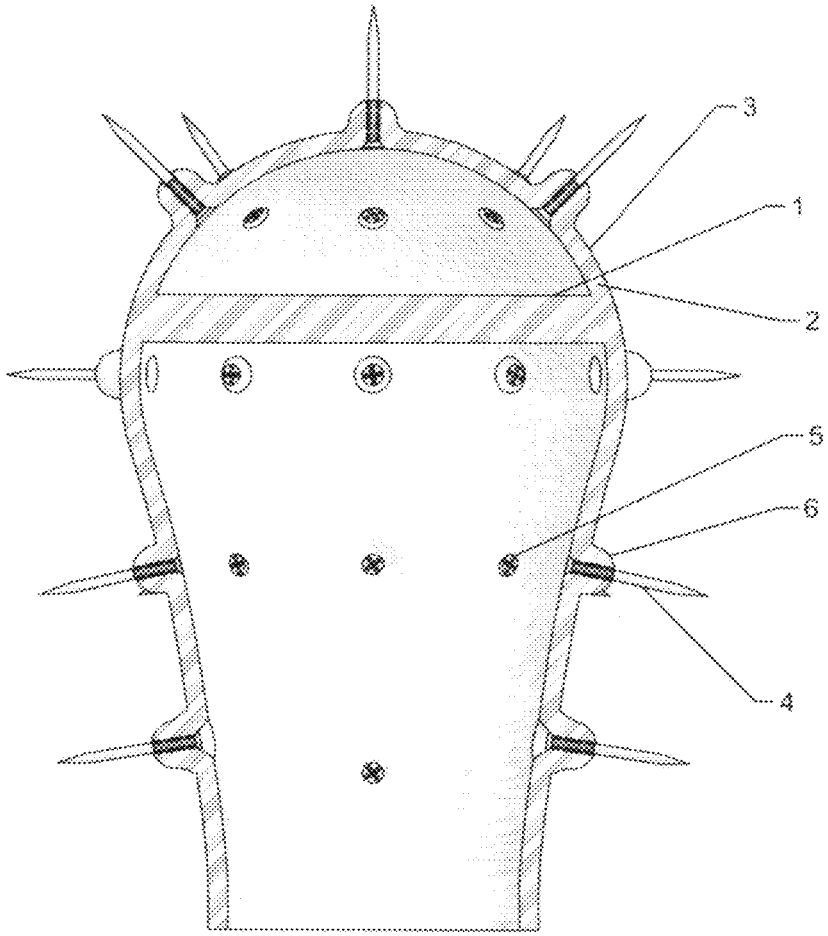
FIG. 4 is cross section through the glove with the pointed spikes installed.

FIG. 1 is a cross section through the glove weapon wherein 1 illustrates a handle that is installed within the forward end of the glove which is in the form a mitten. The handle 1 can be incorporated within the glove during a molding process or it could be installed at a later time by placing the bar 1 into the glove and use fasteners such as pins or screws. The material of the glove could consist of a heavy leather mantle 2 having another plastic layer 3 on the outside. This way, the glove remains somewhat pliant. The material could also be chosen of a plastic substance which could be molded into the proper shape. This would render the structure of the glove weapon somewhat rigid. The choice of a glove weapon to be somewhat flexible, pliant or rigid would depend on the user having an end use or location in mind. FIG. 1 also shows the protruding spikes 4 which are shown to be located all around the glove weapon. The spikes are screwed in to the mantle of the glove weapon by way of screws 5, located on one end of the spikes which penetrate through dimples or mounds 6 on the outside of the glove weapon. The use of the dimples 6 increases the directional stability of the spikes which will prevent the spikes 4 from collapsing or deflecting when in use. FIGS. 2 and 3 illustrate the glove weapon in different views such as a top view in FIG. 2 and a side view in FIG. 3. Both Figs. shows the dimples 6 in the surface of the outer layer 3 and the spikes 4 penetrating through the dimples 6. FIG. 4 illustrates how the spikes 4 are fastened in the glove weapon by being screwed, screw end 5, through the mantle and the dimples 6.

Figure 4A:
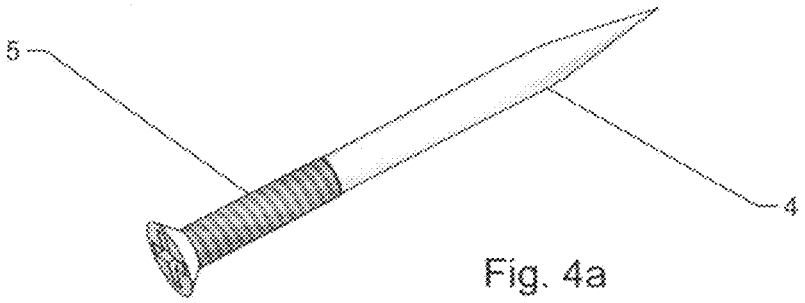
FIG. 4*a* shows the structure of an individual spike.

FIG. 4*a* illustrates the spike 4 itself. The spike 4 has a sharpened end or point and a screw end 5 on the other end. The screw end 5 has the well known end to be used by a screw driver.

What is claimed as being new and desired to be protected by Letters Patent is as follows:

1. A glove weapon in the form of a mitten having an outside mantle and an interior to be occupied by a hand of a user, said interior having a means for maintaining said glove weapon on an arm of a user, said mantle having attached thereto a plurality of outwardly directed spikes being located all-around said glove and having sharpened points; and wherein said mantle comprises a leather material having an outer plastic surface material rendering said glove weapon somewhat flexible.

2. A glove weapon in the form of a mitten having an outside mantle and an interior to be occupied by a hand of a user, said interior having a means for maintaining said glove weapon on an arm of a user, said mantle having attached thereto a plurality of outwardly directed spikes being located all-around said glove and having sharpened points; and wherein said mantle has a multiple of dimples on its outer surface, said dimples being instrumental of maintaining the stability of spikes passing there through.

3. A glove weapon in the form of a mitten having an outside mantle and an interior to be occupied by a hand of a user, said interior having a means for maintaining said glove weapon on an arm of a user, said mantle having attached thereto a plurality of outwardly directed spikes being located all-around said glove and having sharpened points; and wherein said spikes are attached to said mantle by way of screw ends passing through said mantle.

* * * * *